US005182038A

United States Patent [19]

Shirodkar et al.

[11] Patent Number: 5,182,038

[45] Date of Patent: Jan. 26, 1993

[54] MANNICH BASE PHENOL COUPLED MONO AND/OR BIS-SUCCINIMIDE LUBRICATING OIL ADDITIVES

[75] Inventors: Shailaja M. Shirodkar, Wappingers Falls, N.Y.; George P. Speranza, Austin, Tex.

[73] Assignee: Texaco, Inc., White Plains, N.Y.

[21] Appl. No.: 690,239

[22] Filed: Apr. 24, 1991

[51] Int. Cl.[5] ..... C10M 133/56

[52] U.S. Cl. ..... 252/51.5 A; 252/51.5 R; 44/418

[58] Field of Search ..... 252/51.5 A; 44/418

[56] References Cited

U.S. PATENT DOCUMENTS 4,636,322 6/1987 Nalesnik ..... 252/52 A
4,699,724 10/1987 Nalesnik et al. ..... 252/51.5 A
4,713,189 12/1987 Nalesnik ..... 252/51.5 R

*Primary Examiner*—Olik Chaudhuri
*Assistant Examiner*—M. Nuzzolillo
*Attorney, Agent, or Firm*—Robert A. Kulason; James J. O'Loughlin; Vincent A. Mallare

[57] ABSTRACT

A lubricating oil composition having improved dispersancy and a low nitrogen content. The dispersant additive contained in the oil composition being prepared by first forming mono- and/or bis-alkenyl succinimides, with, respectively, an amidoamine, and a phenol and an aldehyde. Then, the succinimides are combined to provide the desired dispersant additive product.

5 Claims, No Drawings

MANNICH BASE PHENOL COUPLED MONO AND/OR BIS-SUCCINIMIDE LUBRICATING OIL ADDITIVES

BACKGROUND OF THE INVENTION

This invention is related to lubricating oil additives, and more particularly to Mannich base-coupled mono and/or bis-succinimide multi-purpose lubricating oil additives.

It is well known that internal combustion engines operate under a wide range of temperatures including low temperature stop-and-go- service as well as high temperature conditions produced by continuous high speed driving. Stop-and-go driving, particularly during cold, damp weather conditions, leads to the formation of a sludge in the crankcase and in the oil passages of a gasoline or a diesel engine. This sludge seriously limits the ability of the crankcase oil to effectively lubricate the engine. In addition, the sludge with its entrapped water tends to contribute to rust formation in the engine. These problems tend to be aggravated by the manufacturer's lubrication service recommendations which specify extended oil drain intervals.

It is known to employ nitrogen containing dispersants and/or detergents in the formulation of crankcase lubricating oil compositions. Many of the known dispersant/detergent compounds are based on the reaction of an alkenylsuccinic acid or anhydride with an amine or polyamine to produce an alkyl succinimide or an alkenylsuccinamic acid as determined by selected conditions of reaction.

It is also known to chlorinate alkenylsuccinic acid or anhydride prior to the reaction with an amine or polyamine in order to produce a reaction product in which a portion of the amine or polyamine is attached directly to the alkenyl radical of the alkenyl succinic acid or anhydride. The thrust of many of these processes is to produce a product having a relatively high level of nitrogen in order to provide improved dispersancy in a crankcase lubricating oil composition.

With the introduction of four cylinder internal combustion engines which must operate at relatively higher engine speeds or RPM's than conventional 6- and 8-cylinder engines in order to produce the required torque output, it has become increasingly difficult to provide a satisfactory dispersant lubricating oil composition.

Thus, an object of the present invention is to provide a lubricating oil composition having superior dispersancy and a low nitrogen content.

Another object is to provide a lubricating oil composition which can withstand the stresses imposed by modern internal combustion engines.

DISCLOSURE STATEMENT

U.S. Pat. Nos. 4,713,189 and 4,699,724 disclose a lubricating oil composition having improved dispersancy and Viton seal compatibility. The dispersant being prepared by coupling two mono-alkenyl succinimides with an aldehyde and a phenol,. The resulting coupled succinimide is then acylated with glycolic acid to form a glycolate Mannich phenol coupled mono-alkenyl succinimide.

U.S. Pat. No. 4,636,322 discloses a lubricating oil composition having improved dispersancy and Viton seal compatibility. The dispersant being prepared by coupling partly glycolate succinimides with an aldehyde and a phenol.

U.S. Pat. No. 4,885,390 discloses novel amino polyols made by alkoxylating ethylene glycol diamine bottoms products, such as triethylene glycol diamine bottoms products, and tetraethylene glycol diamine bottoms products are described. For example, these bottoms products, alone or together, maybe propoxylated in a non-catalytic reaction to give amino polyols that are useful in producing rigid polyurethane foams. The resultant foams have better K-factors and a higher percentage of closed cells than comparable foams made with conventional amino polyols.

The disclosures of U.S. Pat. Nos. 4,636,322; 4,713,189; and 4,699,724 are incorporated herein by reference.

SUMMARY OF THE INVENTION

The present invention provides an additive which improves the dispersancy and provides a low nitrogen content in a lubricating oil. The lubricating oil composition comprises a major portion of a lubricating oil and a minor dispersant amount of a reaction product (i.e., lubricant additive) which may be prepared as set forth below.

PROCESS 30 A process for preparing a lubricating oil dispersant additive comprising:

(a) reacting an amidoamine with an alkenyl succinic acid anhydride to form a mono-and/or bis-alkenyl amidoamine-based succinimide;

(b) reacting the mono-and/or bis-alkenyl amidoamine-based succinimide with a ($C_1$–$C_{18}$) alkyl phenol and an excess of formaldehyde to form a Mannich ($C_1$–$C_{18}$) alkyl phenol coupled mono-and/or bis-alkenyl amidoamine-based succinimide;

(c) combining the Mannich ($C_1$–$C_{18}$) alkyl phenol coupled mono-and/or bis-alkenyl amidoamine-based succinimide with the Mannich phenol coupled mono-and/or bis-alkenyl polyalkyleneamine-based succinimide in a weight ratio of about 25:75 to about 75:25 to provide the desired dispersant additive product; and (d) recovering the dispersant additive product.

DETAILED DESCRIPTION

In carrying out the present process, the reactants are step wise reacted with a long chain hydrocarbyl substituted dicarboxylic acid anhydride containing residual unsaturation in a "one pot reaction". The long chain hydrocarbon group is a ($C_2$–$C_{10}$) polymer, e.q., a ($C_2$–$C_5$) monoolefin, the polymer having a number average molecular weight (Mn) of about 500 to about 10,000.

Preferred olefin polymers for reaction with the unsaturated dicarboxylic acid anhydride or ester are polymers comprising a major molar amount of a ($C_2$–$C_{10}$) polymer, e.g., a ($C_2$–$C_5$) monoolefin.

Such olefins include ethylene, propylene, butylene, isobutylene, pentane, 1-octane, styrene, etc. The polymers can be homopolymers such as polyisobutylene, as well as copolymers of two or more of such olefins such as copolymers of: ethylene and propylene, butylene and isobutylene, propylene and isobutylene, etc. Other copolymers include those in which a minor molar amount of the copolymer monomers e.g., 1 to 10 mole % is a ($C_4$–$C_{10}$) non-conjugated diolefin, e.g., a copolymer of isobutylene and butadiene; or a copolymer of ethylene, propylene and 1,4-hexadiene; etc.

In some cases, the olefin polymer may be completely saturated, for example an ethylene-propylene copolymer made by a Ziegler-Natta synthesis using hydrogen as a moderator to control molecular weight. In this case the alpha- or beta-unsaturated dicarboxylic acid anhydride is reacted with the saturated ethylene-propylene copolymer utilizing a radical initiator. The long chain hydrocarbyl substituted dicarboxylic acid producing material, e.g., acid or anhydride used in the invention includes a long chain hydrocarbon, generally a polyolefin, substituted typically with an average of at least about 0.8 per mole of polyolefin, of an alpha- or beta-unsaturated ($C_4$–$C_{10}$) dicarboxylic acid, anhydride or ester thereof, such as fumaric acid, itaconic acid, maleic acid, maleic anhydride, chloromaleic acid, dimethylfumaratechloromaleic anhydride, and mixtures thereof.

The long chain hydrocarbyl substituted dicarboxylic acid producing material, e.g. acid or anhydride used in the invention includes a long chain hydrocarbon, generally a polyolefin, substituted typically with an average of at least about 0.8 per mole of polyolefin, of an alpha- or beta-unsaturated ($C_4$–$C_{10}$) dicarboxylic acid, anhydride or ester thereof, such as fumaric acid, itaconic acid, maleic acid, maleic anhydride, chloromaleic acid, dimethylfumarate, chloromaleic anhydride and monoacids such as acrylic acid methacrylic acid, crotonic acid, cinnamic acid, and mixtures thereof.

The alkenyl succinic acid anhydride is characterized by the following formula:

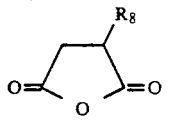

wherein the backbone polymer, $R_8$ is a polyolefin residue which was reacted with maleic acid anhydride to form the alkenyl succinic anhydride, and $R_8$ has a number average molecular weight (Mn) ranging from about 500 to about 10,000, preferably from about 1000 to about 5000, and more preferably from about 2000 to about 2500.

The amidoamines used in the invention may be characterized by the formula $$YR_5\text{-}(XR_4)_m\text{-}(YR_5)_n\text{-}(XR_4)_m\text{-}NHCO\text{-}(CH_2)_p\text{-}CONHR_4\text{-}(XR_4)_m\text{-}(YR_5)_n\text{-}(XR_4)_m\text{-}Y.$$

In the above formula, X and Y each are oxygen and nitrogen atoms; m is 2 and n is 1-5. $R_4$ and $R_5$ may be a lower alkyl group, i.e., ($C_1$–$C_{10}$) alkyl groups including methyl, ethyl, n-propyl, i-propyl, butyl, amyl, hexyl, octyl, decyl among others. Preferably, $R_4$ and $R_5$ are each ($CH_2$—$CH_2$—), m is 2, n is 1, Y is nitrogen and X is oxygen. In the above compound, p can range from 2 to 10; preferably p is 4 as in the case of adipic acid. The amidoamines may be synthesized by a condensation reaction of two moles of an appropriate amine with one mole of adipic acid.

The preferred amidoamine is represented by the following formula $$NH_2CH_2CH_2\text{—}(OCH_2CH_2)_2\text{—}NHCH_2CH_2\text{—}(OCH_2CH_2)_2\text{—}NHCO\text{—}(CH_2)_4\text{—}CONH\text{—}CH_2CH_2\text{—}(OCH_2CH_2)_2\text{—}NHCH_2CH_2\text{—}(OCH_2CH_2)_2\text{—}NH_2$$

A main constituent in the amine from which the amidoamine is synthesized is:

$$NH_2\text{—}(CH_2CH_2O)_2\text{—}CH_2CH_2\text{—}NH\text{—}(CH_2CH_2O)_2\text{—}CH_2CH_2NH_2$$

The analysis of the amine is provided below in Table 1.

TABLE 1

| | mg/g |
|---|---|
| Total Acetables | 10.0 |
| Total amine | 9.3 |
| Primary amine | 5.9 |
| Secondary amine | 3.3 |
| Tertiary amine | 0.1 |
| Hydroxy group | 0.8 |

The aldehyde which may be employed may include those preferably which are characterized by the formula $$R_6CHO$$

In the preceding compound, $R_6$ may be hydrogen or a hydrocarbon group consisting of alkyl, aralkyl, cycloalkyl, aryl, alkyaryl, alkenyl, and alkynyl including such radicals when inertly substituted. When $R_6$ is alkyl, it may typically be methyl, ethyl, n-propyl, isopropyl, n-butyl, isobutyl, sec-butyl, amyl, octyl, decyl, dodecyl, octadecyl, etc. When $R_6$ is aralkyl, it may typically be benzyl, beta-phenylethyl, etc. When $R_6$ is cycloalkyl, it may typically be cyclohexyl, cycloheptyl, cyclooctyl, 2-methylcycloheptyl, 3-butylcyclohexyl, 3-methylcyclohexyl, etc. When $R_6$ is alkylaryl, it may typically be tolyl, xylyl, etc. When $R_6$ is alkylnyl, it may typically be ethynyl, propynyl, butynyl, etc. When $R_6$ is aryl, it may typically be phenyl, naphthyl, etc. When $R_6$ is alkenyl, it may typically be vinyl, allyl, 1-butenyl, etc. $R_6$ may be inertly substituted i.e. it may bear a non-reactive substituent such as alkyl, aryl, cycloalkyl, ether, nalogen, nitro, etc. Typically inertly substituted R groups may include 3-chloropropyl, 2-ethoxyethyl, carboethoxymethyl, 4-methyl cyclohexyl, p-chlorophenyl, p-chlorob--nzyl, 3-chloro-5-methylphenyl, etc. The preferred $R_6$ groups may be lower alkyl, i.e. $C_1$–$C_{10}$ alkyl, groups including methyl, ethyl, n-propyl, isopropyl, butyls, amyls, hexyls, octyls, decyls, etc. $R_6$ may preferably be hydrogen.

Typical aldehydes which may be emplo-yed may include those listed below in Table 2.

TABLE 2

| |
|---|
| formaldehyde |
| ethanal |
| propanal |
| butanal, etc. |

The alkylphenols which may be employed in practice of the process of this invention may preferably be characterized by the following formula

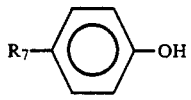

According to this invention, these alkylphenols may contain an active hydrogen which will be a site for substitution. Polyphenols (e.g., compounds containing more than one hydroxy group in the molecule whether on the same ring or not) may be employed. The rings on which the hydroxy groups are situated may bear substituents. In particular they may be substituted with $R_7$ alkyl groups either branched, linear or cyclic or a combination thereof containing 1 to 18 carbons. However, at least two positions, e.g., ortho- and para-, to a hydroxy group, must be occupied by an actve hydrogen as this is the point of reaction with the iminium salt group. The preferred alkylphenol is nonylphenol.

In the present process, the mono-and/or bis-alkenyl amidoamine-based succinimide is reacted with a ($C_1$–$C_{18}$) alkyl phenol and an excess of formaldehyde to form a Mannich ($C_1$–$C_{18}$) alkyl phenol coupled mono- and or bis-alkenyl amidoamine-based succinimide which may be represented by the formula

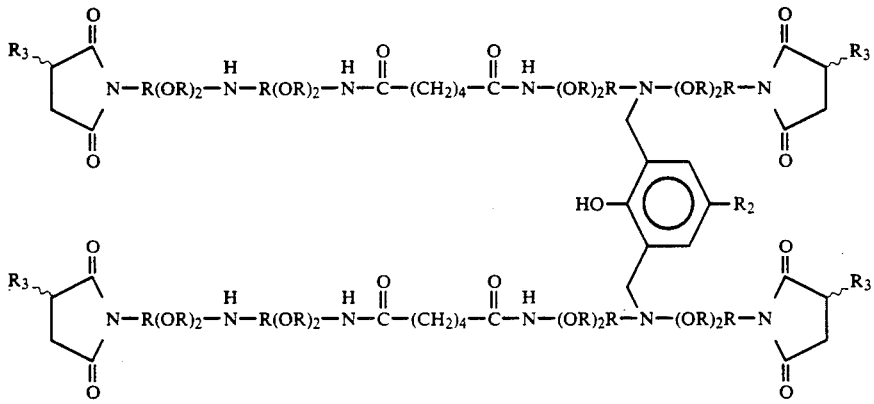

wherein R is [$CH_2CH_2$—]; $R_2$ is ($C_9$ $H_{19}$) and $R_3$ is polyisobutylene (PIB).

In preparing the dispersant additive product of this invention, the succinimides (i.e., Mannich ($C_1$–$C_{18}$) alkyl phenol coupled mono-and/or bis-alkenyl amidoami-e-based succinimide and Mannich phenol coupled mono-and/or bis-alkenyl polyalkyleneamine-based succinimide) are combined in weight ratio of about 25:75 to about 75:25 to provide the additive product. More preferably, the weight ratio is about 50:50.

The lubricating oil of the present invention may contain the novel reaction product in a concentration ranging from about 0.1 to 30 weight percent. A concentration range for the additive ranging from about 0.5 to 15 wei-ht percent based on the total weight of the oil composition is preferred with a still more preferred concentration range being from about 1 to 8.0 weight percent.

Oil concentrates of the additives mav contain from about 1 to 75 weight percent of the additive reaction product in a carrier or diluent oil of lubricating oil viscosity.

The above process and products are illustrated in the Examples below and by reviewing such Examples the present invention and its advantages will be more apparent.

EXAMPLE

Preparation Of Amidoamine

To a 2 L three-necked flask equipped with a stirrer, thermometer and Dean Stark trap was added the amine (690 g), followed by addition of adipic acid (146g). The reaction mixture was heated at 190° C. for 5 hrs., while gradually raising the temperature. A total of 44 Ml of water was collected, with the final product yield being 788g. Th-- amidoamine product analyzed as follows: Total amine 5.4 mg/g; Tertiary amine=0.1 mg/g and primary amine=2.5 mg/g.

EXAMPLE II

Preparation Of Mannich Nonyphenol Coupled Mono-And/Or Bis-Alkenyl Amidoamine-Based Succinimide (Dispersant #1)

A solution of polyisobutenylsuccinic acid anhydride (2379 g, 0.6 moles, SAP no. 28) PIBSA prepared from an approximately 2060 mol. wt. polybutene) in diluent oil 1203 g) was charged into a twelve liter 3-neck flask equipped with a mechanical stirrer, thermometer, thermocouple, and nitrogen inlet and heated to 60° C. Next amidoamine (220.40 g, 0.33 moles) was added and the heat was increased to 120° C. and maintained for 2.0 hours. Then, nonylphenol (35.64 g, 0 16 moles) was added, followed by a 37% solution of formaldehyde (52.70 g, 0.65 moles). The temperature was maintained at 1120° C. for 0.5 hours. The temperature was raised to 160° C. and then maintained for 4 hours to drive off water. The hot mxture (~100° C.) was filtered through diatomaceous earth filter aid. The product, i.e., the Mannich nonylphenol coupled mono-and/or bis-alkenyl amidoamine-based succinimide (dispersant #1) (an approximately 40% concentrate) analyzed as follows: % N =0.56 (0.6 calc.), Total Acid Number (TAN)=1.90, and Total Base Number (TBN)=15.30.

EXAMPLE III

Preparation Of Mannich Phenol Coupled Mono-And/Or Bis-Alkenyl Polyalkenylene Amine-Based Succinimide (Dispersant #2)

The same procedure as Example II was used except pentaethylene hexamine was substituted for amidoamine. The product, i.e., the Mannich phenol coupled mono-and/or bis-alkenyl polyalkyleneamine-based succinimide (dispersant #2) is that produced and sold by Dow Chemical Company of Midland, Mich., under the Tradename of DOW E-100. An approximately 50% concentrate, was analyzed as follows: % N=0.70 ( 0.71 calc.), Total Acid Number (TAN)=4.0, and Total Base Number (TBN)=8.4.

EXAMPLE IV

Preparation Of (Combination Dispersant #3) Mannich Nonylphenol Coupled Mono-And/Or Bis-Alkenyl Amidoamine-Based Succinimide And Mannich Nonylphenol Coupled Mono-And/or Bis-Alkenyl Polyalkylene-Based Succinimide In this example, Mannich Nonylphenol Coupled Mono-And/Or Bis-Alkenyl Admidoamine-Based Succinimide (Example II) and Mannich Nonylphenol Coupled Mono-And/or Bis-Alkenyl Polyalkylene-based Succinimide (Example III) were mixed in a 50:50 ratio by weight and blended to provide the product, i.e., the (dispersant #3) additive of this invention which was analyzed as follows: %N=0.63

EXAMPLE V

Sequence VE Gasoline Engine Test Results

The ASTM Sequence VE gasoline engine test is used to evaluate the performance of gasoline engine oils in protecting engine parts from sludge and varnish deposits and valve train wear due to low temperature "stop and go" operation. The test uses a Ford 2.3 L four-cylinder Ranger truck engine. The engine is cycled through three test stages, requiring four hours to complete, for 288 hours or 72 cycles. The Sequence VE gasoline engine test results shown below in Table 3 were run in a single grade fully formulated motor oil

TABLE 3

| | Sequence VE Gasoline Engine Test Results | | | | | | | |
|---|---|---|---|---|---|---|---|---|
| Dispersant | AS[1] | AV | RACS | PSV | % ORC | % OSC | $CLW_{avg}$ | $CLW_{max}$ |
| Example[2] III | 8.4 | 0.4 | 7.4 | 6.9 | 25.0 | 0.0 | 4.0 | 11.2 |
| Example[2] IV | 9.0 | 4.8 | 7.9 | 6.8 | 0.0 | 0.0 | 0.9 | 1.5 |
| Limits | $9.0_{min}$ | $5.0_{min}$ | $7.0_{min}$ | $6.5_{min}$ | $15.0_{max}$ | $20.0_{max}$ | $5_{max}$ | $15_{max}$ |

[1]AS, AV, RASC, PSV, ORC, OSC, $CLW_{avg}$ and $CLW_{max}$ denote: average sludge, average varnish, rocker arm cover sludge, piston skirt varnish, oil ring clogging, oil screen clogging, cam lobe wear average, and cam lobe wear maximum, respectively.

[2]SAE 30 fully formulated motor oil

The results in Table 3 indicate dispersant (#3) to be a superior to dispersant (#2) in average sludge rating. Also, inspection of the results reveal that dispersant (#3) is superior to dispersant (#2) in % Oil ring clogging and Cam lobe wear maximum rating.

EXAMPLE VI

Bench Sludge Test

This test is conducted by heating the test oil mixed with synthetic hydrocarbon blowby and a diluent oil at a fixed temperature for a fixed time period. After heating, the turbidity of the resulting mixture is measured. A low percentage turbidity (20–40) is indicative of good dispersancy while a high value (40 to 200) is indicative of an oil's increasingly poor dispersancy. The resuls obtained with the known and present dispersants are set forth below in Table 4 below at 6.5% percent by weight concentration, in a SAE 30W fully formulated motor oil.

TABLE 4

| Bench Sludge Test Results | |
|---|---|
| Dispersant | Rating |
| Example III | 67 |
| Example IV | 46 |
| Reference (SG) | 33 |
| Reference (good) | 33 |
| Reference (fair) | 48 |

TABLE 4-continued

| Bench Sludge Test Results | |
|---|---|
| Dispersant | Rating |
| Reference (poor) | 93 |

EXAMPLE VI

Bench Oxidation Test Results

The Bench Oxidation Test (BOT) was used to determine if the dispersants of this inyention have anti-oxidant properties. In this test, the oil composition is heated to 175° C. under a blanket of nitrogen. A sample is taken to establish a base line. The oil is maintained at 175° C. while a stream of air is passed through it at the rate of 500 mL/minute for six hours. Samples are taken every hour and the DIR of each sample is determined against the base line 1712 cm-1. The DIR is used as a measure of oxidation. In these tests, the oil employed was a solvent neutral oil having an SUS viscosity at 100° F. of 130. In the tested oils, the additive was employed at nitrogen concentration of 0.1 weight percent. The examples in Table 5, below, illustrate the advantage of the novel lubricant dispersant additive (#1) over dispersant additive (#2) in reduction of the prooxidant behavior of the dispersant.

TABLE 5

| Dispersant | BOT Results[2] |
|---|---|
| Example III | 20.7 |
| Example IV | 12.5 |

[2]The higher the number above 7 the more pro-oxidant character. The lower the number below 7 the more anti-oxidant character.

We claim:

1. A lubricating oil composition comprising a major portion of a lubricating oil and a minor amount of a dispersant additive prepared by the process comprising:
   (a) reacting an amidoamine wi-th an alkenyl succinic acid anhydride to form a mono-and/or bis-alkenyl amidoamine-based succinimide;
   (b) reacting said -mono-and/or bis-alkenyl amidoamine-based succinimide with a ($C_1$–$C_{18}$) alkyl phenol and an excess of formaldehyde to form a Mannich ($C_1$–$C_{18}$) alkyl phenol coupled mono-and/or bis-alkenyl amidoam:ine-based succinimide;
   (c) combining said Mannich ($C_1$–$C_{18}$) alkyl phenol coupled mono-and/or bis-alkenyl amidoamine-based succinimide with a Mannich phenol coupled mono-and/or bis-alkenyl polyalkyleneamine-based succinim,ide in a weight ratio of about 25:75 to about 75:25 to provide the dispersant additive product; and
   (d) recovering said dispersant additive product.

2. The lubricating oil composition of claim 1, wherein the alkyl phenol is nonylphenol.

3. The lubricating oil compositon of claim 1, wherein the weight ratio of the combined succinimide is about 50:50.

where $R_1$ is $[CH_2CH_2—]$ or $[CH_2CH_2(OCH_2CH_2-)_2—]$; $R_2$ is $(C_9H_{19})$ and $R_3$ is polyisobutylene;

4. The lubricating oil composition of claim 1, wherein said alkenyl succinic acid anhydride has a number average molecular weight of about 500 to about 10,000.

5. The lubricating oil composition of claim 1, wherein sai damidoamine is represented by the formula $$YR_5\text{-}(XR_4)_m\text{-}(YR_5)_n\text{-}(XR_4)_m\text{-}NHCO\text{-}(CH_2)_p\text{-}CONHR_4\text{-}(XR_4)_m\text{-}(YR_5)_n\text{-}(XR_4)_m\text{-}Y$$

wherein X and Y each are oxygen and nitrogen; $R_4$ and $R_5$ each are $(C_1-C_{10})$ alkyl groups; m is 2; n is 1-5; and p is 2-10.

* * * * *